US010892116B2

(12) United States Patent
Ferrari et al.

(10) Patent No.: US 10,892,116 B2
(45) Date of Patent: Jan. 12, 2021

(54) DURABLE AND SECURED SWITCH ASSEMBLY

(71) Applicant: Ferrari Interconnect Solutions, Inc., Ontario, CA (US)

(72) Inventors: David Ferrari, Ontario, CA (US); Karina Vera, Ontario, CA (US)

( * ) Notice: Subject to any disclaimer, the term of this patent is extended or adjusted under 35 U.S.C. 154(b) by 12 days.

(21) Appl. No.: 15/784,738

(22) Filed: Oct. 16, 2017

(65) Prior Publication Data

US 2019/0115166 A1 Apr. 18, 2019

(51) Int. Cl.

| | |
|---|---|
| ***H01H 13/06*** | (2006.01) |
| ***H01H 13/04*** | (2006.01) |
| ***H01H 13/14*** | (2006.01) |
| ***H01H 9/02*** | (2006.01) |

(52) U.S. Cl.

CPC ..... *H01H 13/04* (2013.01); *H01H 9/0228* (2013.01); *H01H 13/06* (2013.01); *H01H 13/14* (2013.01); *H01H 2223/002* (2013.01); *H01H 2223/044* (2013.01)

(58) Field of Classification Search

CPC .. H01H 13/06; H01H 13/04; H01H 2223/002; H01H 2207/034; H01H 2225/02; H01H 13/56; H01H 13/58; H01H 13/5844; H01H 13/86; H01H 9/0228

See application file for complete search history.

(56) References Cited

U.S. PATENT DOCUMENTS

| | | | | |
|---|---|---|---|---|
| 2,740,024 | A * | 3/1956 | Rogers | H01H 13/06 200/296 |
| 4,877,930 | A * | 10/1989 | Fukuma | H01H 9/04 200/302.2 |
| 4,985,605 | A * | 1/1991 | Valenzona | H01H 13/585 200/275 |
| 5,329,083 | A * | 7/1994 | Lai | H01H 13/06 200/302.2 |
| 7,148,440 | B2 * | 12/2006 | Gjerde | H01H 3/0206 200/569 |
| 7,764,936 | B2 * | 7/2010 | Nakasono | G07C 9/00944 200/302.2 |
| 8,497,440 | B2 * | 7/2013 | Kitahara | H01H 13/06 200/302.2 |
| 8,513,554 | B2 * | 8/2013 | Peng | H01H 9/0228 200/332.1 |

(Continued)

*Primary Examiner* — Felix O Figueroa

(74) *Attorney, Agent, or Firm* — Rao DeBoer Osterrieder, PLLC; Erik J. Osterrieder

(57) ABSTRACT

A durable and secured switch assembly includes an alternate action switch with a push button on one end and two primary cable terminals on the opposing end. The switch is secured in a housing with a lumen configured to securely retain the switch body. A first section of the lumen at the proximal end includes peripheral spacing for epoxy between the switch body and the inside wall of the housing. A second section of the lumen at the distal end includes a second peripheral spacing for epoxy between the switch body and the inside wall of the housing. The second section includes a peripheral notch for securing a cover that encloses the primary cable terminals in a cavity that is filled with epoxy. The housing includes a primary channel that connects a primary cable to the primary cable terminals and secondary channel for securing a secondary cable to the housing.

13 Claims, 5 Drawing Sheets

(56) References Cited

U.S. PATENT DOCUMENTS

| | | | | |
|---|---|---|---|---|
| 8,822,863 | B2 * | 9/2014 | Tittle | H01H 13/06 200/534 |
| 9,761,388 | B2 * | 9/2017 | Kitahara | H01H 13/06 |
| 2010/0230262 | A1 * | 9/2010 | Devine | H01H 13/06 200/302.2 |
| 2016/0380424 | A1 * | 12/2016 | Aromin | H02H 3/162 361/50 |
| 2018/0301297 | A1 * | 10/2018 | Ohara | H01H 13/10 |

* cited by examiner

DURABLE AND SECURED SWITCH ASSEMBLY

BACKGROUND OF THE INVENTION

Field of the Invention

Embodiments of the invention relates to the field of electrical switch assemblies. More specifically, the invention relates to a durable and secured housing for a switch in high vibration environments.

Description of the Related Art

Most military aircraft pilots carry their personal communication equipment as part of their flight suit. Usually when a pilot enters the cockpit, he/she plugs the communication equipment cable into the appropriate aircraft's communication system port. Currently, the personal communication equipment cable includes a switch and housing assembly that is susceptible to unintentional activation by being bumped in the narrow confines of the cockpit, is bulky and is hard to feel, especially for a person wearing a thick glove. The size of the prior art switch is one of the reasons that it is difficult to utilize since one needs to locate the rocker in the middle of the large housing and then actuate. The switch assembly is also susceptible to fracturing and to moisture accumulation.

Accordingly, there is a need for a switch assembly for personal communication equipment that avoids the aforementioned problems in the prior art.

BRIEF SUMMARY OF THE INVENTION

One or more embodiments of the invention are directed to a durable and secured switch assembly that is much more compact than prior art designs and may be simply actuated by finger or palm regardless its position. The invention comprises an alternate action switch enclosed in a tubular housing. The switch comprises a switch body, a push button on a proximal end of the switch body, and two primary cable terminals on a distal end of the switch body.

In one or more embodiments, the housing has a lumen configured to securely retain the switch body. The lumen has first section that is configured to provide a first peripheral spacing between the switch body and the wall of the housing at the proximal end of the switch body. The lumen also has a second section that is configured with a second peripheral spacing between the switch body and the wall of the housing at the distal end of the switch body. Between the first and second section of the lumen is a section that acts as a stop to prevent downward movement of the switch body within the housing. The second section includes a peripheral notch near its bottom end. The housing further comprises a channel across its bottom end, i.e. from the left side to the right side. The channel comprises a first portion of a primary cable channel.

In one or more embodiments, a cover that is configured to snap fit into the peripheral notch is coupled to the distal end of the housing to enclose the primary cable terminals. The cover includes a cavity for the primary cable terminals. The cover includes the second portion of the primary cable channel running from one side of the cover to an opposing side of the cover. The first and second portions together form an orifice that is a channel for connecting a primary cable to the primary cable terminals.

In one or more embodiments, the cover further comprises one or more external access holes for injecting epoxy into the cavity.

In one or more embodiments, the first peripheral spacing, the second peripheral spacing and the cavity are filled with epoxy or similar type non-conductive material.

In one or more embodiments, the spacing between an outside wall of the housing and an outside wall of the cover forms a secondary cable channel for securing a secondary cable to the housing.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION

Figure 1:
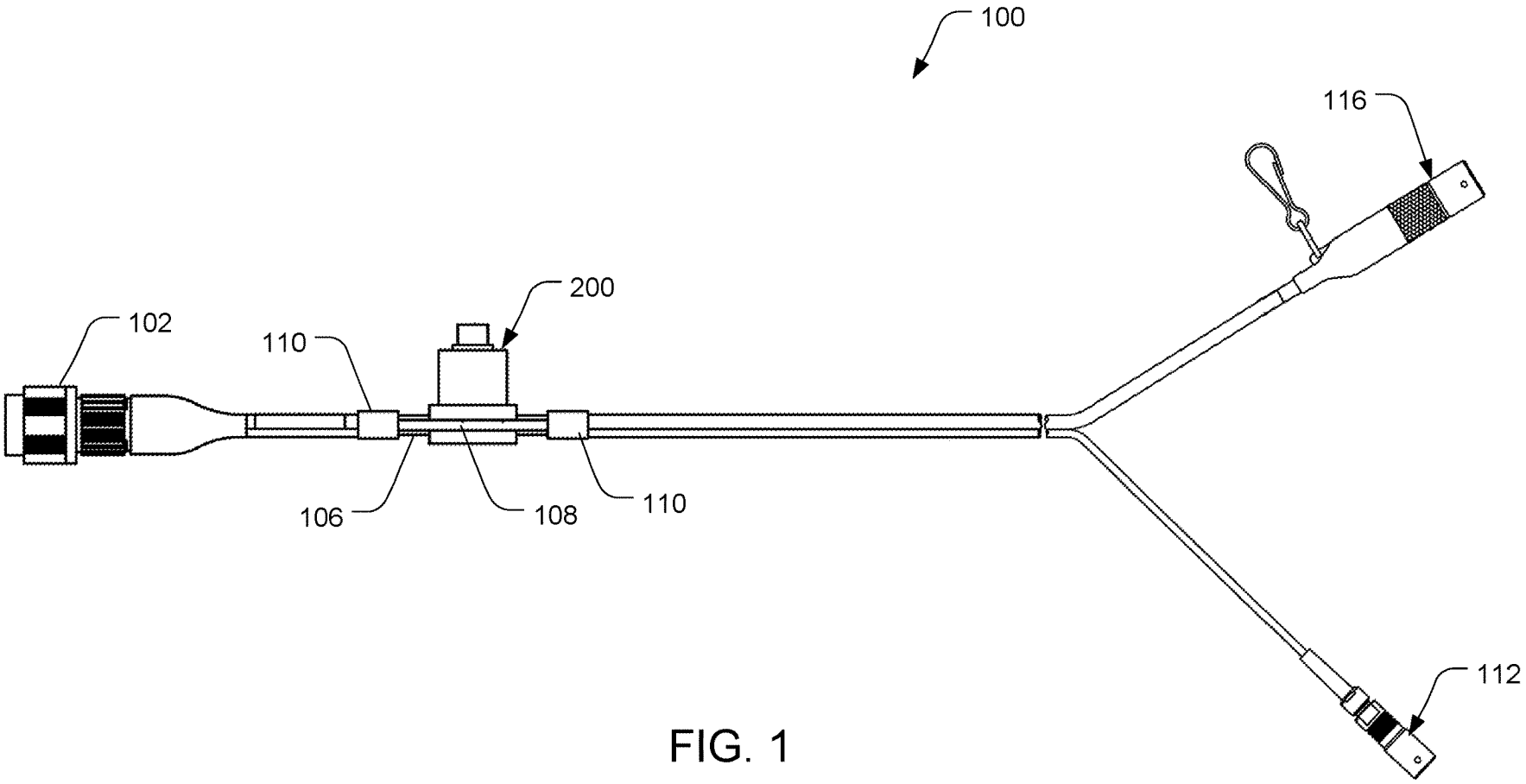
FIG. 1 is an illustration of a personal communication cable assembly with switch enclosed in a housing in accordance with one or more embodiments of the present invention.

The present invention comprising a durable and secured switch assembly will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. Furthermore, although steps or processes are set forth in an exemplary order to provide an understanding of one or more systems and methods, the exemplary order is not meant to be limiting. One of ordinary skill in the art would recognize that the steps or processes may be performed in a different order, and that one or more steps or processes may be performed simultaneously or in multiple process flows without departing from the spirit or the scope of the invention. In other instances, specific features, quantities, or measurements well known to those of ordinary skill in the art have not been described in detail so as not to obscure the invention. It should be noted that although examples of the invention are set forth herein, the claims, and the full scope of any equivalents, are what define the metes and bounds of the invention.

For a better understanding of the disclosed embodiment, its operating advantages, and the specified object attained by its uses, reference should be made to the accompanying drawings and descriptive matter in which there are illustrated exemplary disclosed embodiments. The disclosed embodiments are not intended to be limited to the specific forms set forth herein. It is understood that various omissions and substitutions of equivalents are contemplated as circumstances may suggest or render expedient, but these are intended to cover the application or implementation.

The term "first", "second" and the like, herein do not denote any order, quantity or importance, but rather are used to distinguish one element from another, and the terms "a" and "an" herein do not denote a limitation of quantity, but rather denote the presence of at least one of the referenced item.

One or more embodiments of the present invention will now be described with references to FIGS. 1-5D.

One or more embodiments of the invention comprises a switch and housing assembly 200 in a personal communication cable assembly 100. The personal communication cable includes one or more connectors, e.g. 116, 112, and 102. The personal communication cable further includes a primary cable 106 electrically connected a switch 200 and a secondary cable 108 mechanically retained by the switch housing. On each side of the switch is an adhesive heat shrink 110.

Figure 2C:
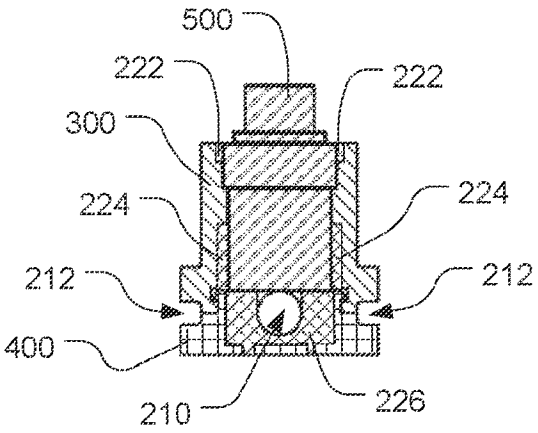
FIG. 2C is a cross-sectional view of the personal communication cable switch and the durable protective housing in accordance with one or more embodiments of the present invention.
Figure 2B:
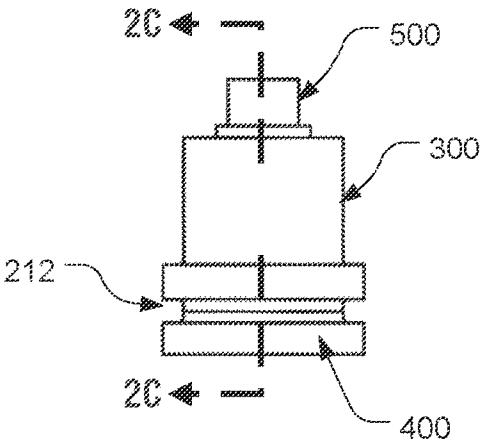
FIG. 2B is a front/back side view of the personal communication cable switch and the durable protective housing in accordance with one or more embodiments of the present invention.
Figure 2A:
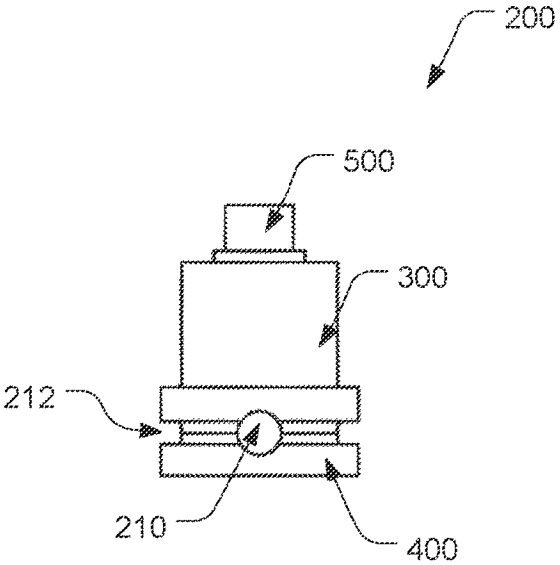
FIG. 2A is a left/right side view of a personal communication cable switch and the durable protective housing in accordance with one or more embodiments of the present invention.
Figure 3C:
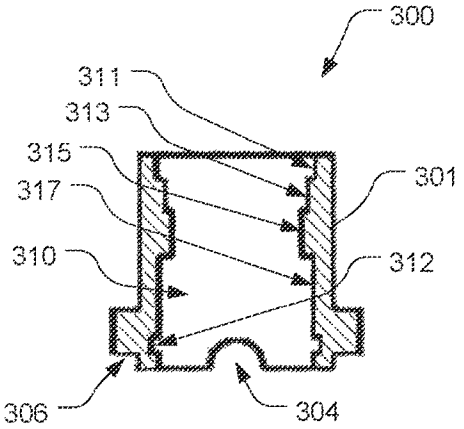
FIG. 3C is a cross-sectional view (i.e. front to back) of the durable protective housing in accordance with one or more embodiments of the present invention.
Figure 3D:
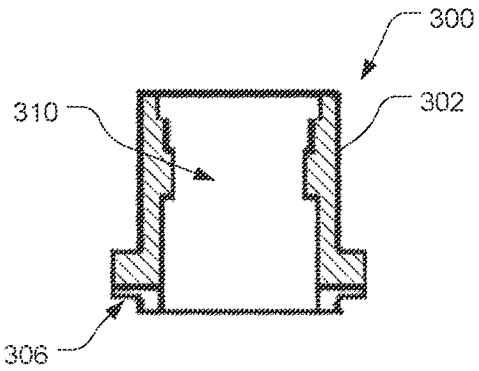
FIG. 3D is a cross-sectional view (i.e. left to right) of the durable protective housing in accordance with one or more embodiments of the present invention.
Figure 3A:
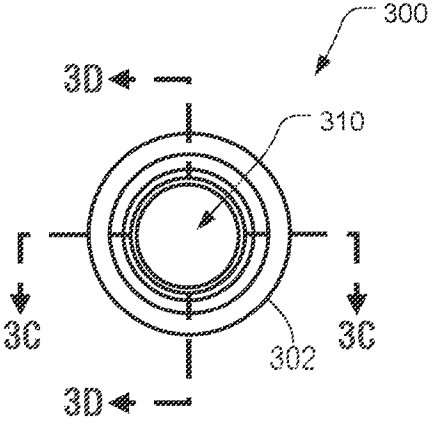
FIG. 3A is a top view of the durable protective housing in accordance with one or more embodiments of the present invention.
Figure 3B:
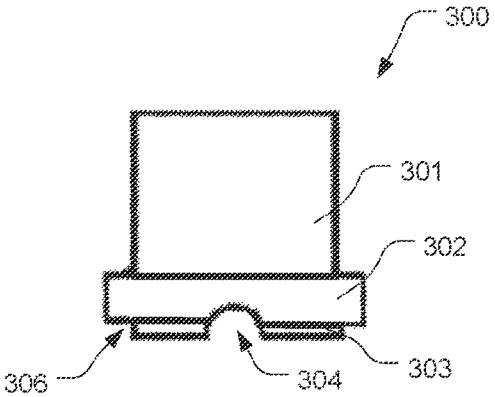
FIG. 3B is a left/right side view of the durable protective housing in accordance with one or more embodiments of the present invention.
Figure 4C:
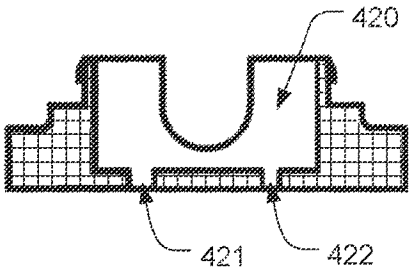
FIG. 4C is a cross-sectional view (i.e. front to back) of the back fitting for the durable protective housing in accordance with one or more embodiments of the present invention.
Figure 4D:
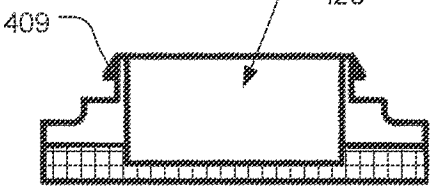
FIG. 4D is a cross-sectional view (i.e. left to right) of the back fitting for the durable protective housing in accordance with one or more embodiments of the present invention.
Figure 4A:
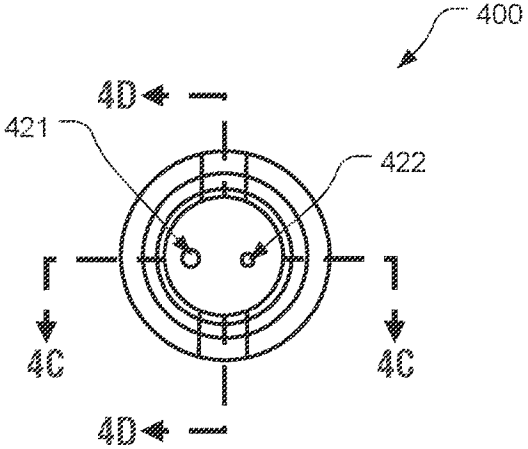
FIG. 4A is a top view of the back fitting of the durable protective housing in accordance with one or more embodiments of the present invention.
Figure 4B:
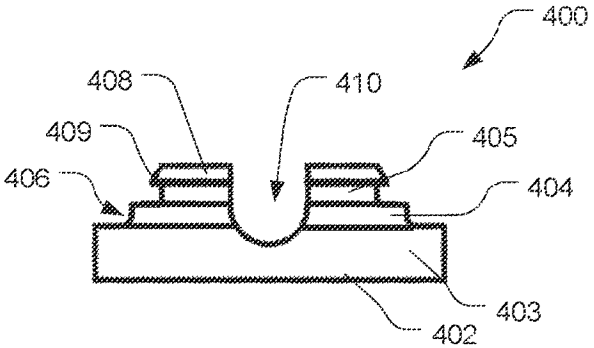
FIG. 4B is a left/right side view of the back fitting for the durable protective housing in accordance with one or more embodiments of the present invention.
Figure 5C:
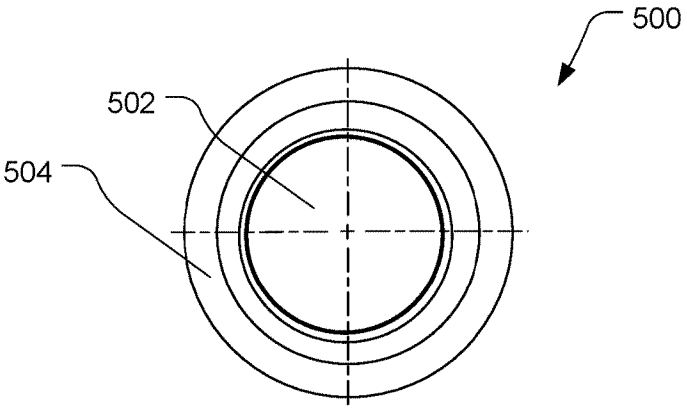
FIG. 5C is a top view of the alternate action switch in accordance with one or more embodiments of the present invention.
Figure 5D:
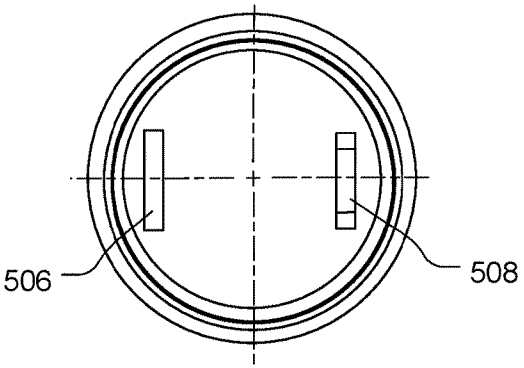
FIG. 5D is a bottom view of the alternate action switch in accordance with one or more embodiments of the present invention.
Figure 5A:
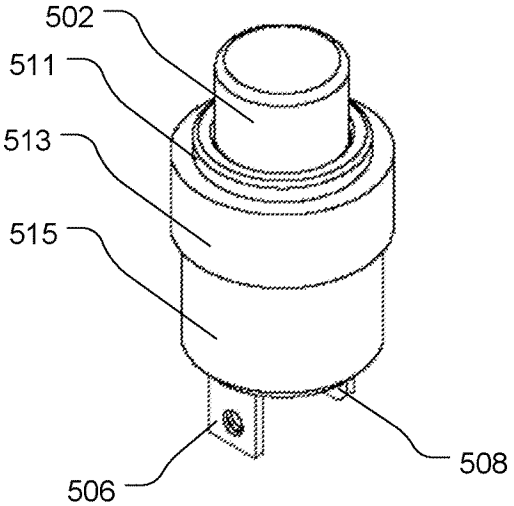
FIG. 5A is an isometric view of the alternate action switch in accordance with one or more embodiments of the present invention.
Figure 5B:
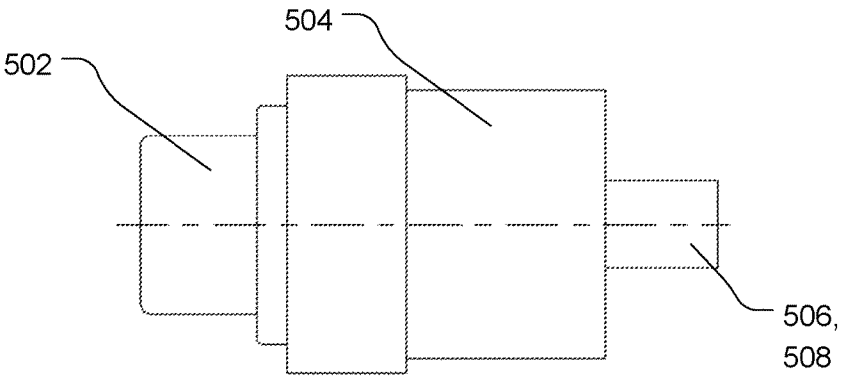
FIG. 5B is a left/right side view of the alternate action switch in accordance with one or more embodiments of the present invention.

FIGS. 2A-2C are illustrations of the durable protective housing and switch assembly 200 in accordance with one or more embodiments of the present invention. As illustrated, the switch assembly 200 comprises alternate action (i.e. Push On-Push Off) switch 500; housing 300; back fitting (or cover) 400; primary cable channel 210; and secondary cable channel 212. In one or more embodiments, the alternate action switch 500 is configured to fit inside lumen 310 of the housing unit 300. The space in the lumen 310 of housing 300 that is not occupied by the switch, e.g. 222 and 224, is filled with epoxy. In addition, the space inside back fitting, e.g. 226, is filled with epoxy.

FIGS. 3A-3D are illustrations of the housing 300 in accordance with one or more embodiments of the present invention. As illustrated, the housing 300 comprises a tubular body structure with a lumen 310 running the length of the body, i.e. from the top (or proximal) end to the bottom (or distal) end. Housing 300 further comprises a channel, e.g. 304, across its bottom end, i.e. from the left side to the right side. Channel 304 is a first portion of the primary cable channel 210.

In one or more embodiments, the perimeter of housing 300 comprises a first outside section 301 that begins from the top of the housing and runs towards the bottom of the housing; a second outside section 302 abutting the first section 301 and that is larger than the first section 301; and a third outside section 303 abutting the second section 302 and that is approximately the same size as the first outside section 301 and runs to the bottom of the housing 300. The space, e.g. 306, defined by sidewall of the third outside section 303 and bottom wall of the second outside section 302 comprises a first portion 306 of the secondary cable channel 212 around the perimeter of the bottom end of the housing 300. The peripheral shape of body 300 may be cylindrical, cubic, or any other shape. Those of skill in the arts would appreciate that the external shape of body 300 may differ from that shown without deviating from the invention.

Lumen 310 comprises a first section 311 at the proximal end with a diameter slightly larger than the largest outer diameter, i.e. 513, of switch 500. The lumen 310 of housing 300 further comprises a second section 313, abutting the first section 311, with a diameter smaller than section 311 and approximately equal to the largest outer diameter, i.e. 513, of switch 500 thus sufficient to snugly fit section 513 of switch 500. The depth of section 313 of the lumen is approximately the height of section 513 of switch 500. In one or more embodiments, the diameter of section 311 is sufficient to provide space, e.g. 222, between the outside section 511 of switch 500 and the inside wall of section 311 for epoxy or similar material for sealing the space around the switch body at section 511. The epoxy seal helps prevent moisture from entering the switch assembly 200. Those of skill in the art would appreciate that materials other than epoxy may be used for sealing in space 222. In one or more embodiments, space 222 may be omitted entirely.

The lumen 310 of housing 300 further comprises a third section 315 abutting the second section 313 and running to approximately halfway towards the distal end of housing 300. The diameter of the third section 315 is smaller than the first section, i.e. 311, and second section, i.e. 313, and is sufficient to act as a stop to restrain the downward movement of switch 500. The lumen 310 of housing 300 further comprises a fourth section 317 abutting the third section 315 and running to the distal end of housing 300. The diameter of the fourth section 317 is larger than the third section, i.e. 315, and provides space for epoxy to seal the space around the switch body at section 515. The epoxy seal helps prevent moisture from entering the switch assembly 200. Those of skill in the art would appreciate that materials other than epoxy may be used for sealing in space 224. In one or more embodiments, space 224 may be omitted entirely.

The fourth section 317 of lumen 310 further comprises a notch 312 around the inside perimeter of lumen 310 near the distal end of housing 300. Notch 312 is configured to receive and flange 409 of bottom fitting (or cover) 400 thus securing the cover 400 to the housing 300.

FIGS. 4A-4D are illustrations of the cover 400 in accordance with one or more embodiments of the present invention. As illustrated, the cover 400 comprises a bottom wall 402 from which a sidewall extends upwardly therefrom to form a recessed compartment (or cavity) 420. The sidewall of the cover 400 comprises a first section 403 rising from the bottom wall 402 and adjoining a smaller second section 404. The perimeter of first section 403 is approximately the same as the perimeter of section 302 of housing 300 and the perimeter of second section 404 is approximately the same as the perimeter of section 303 of housing 300. Thus, space, e.g. 406, defined by the top wall of the first section 403 and the sidewall of second section 404 comprises a second portion of the secondary cable channel 212 around the perimeter of device 200. The sidewall of the cover 400 further comprises a third section 405 abutting the second section 404. The perimeter of section 405 is configured to tightly and completely fit into the fourth section 317 of lumen 310 of housing 300. The fourth section 407 comprises a tip with an outwardly extending flange 409, which is configured to snap fit into notch 312 in the housing unit 300.

Cover 400 further comprises a second channel, e.g. 410, across its top side. Channel 410 is a second portion of the primary cable channel 210. The depth of channel 410 runs from the tip of the cover section 405 the top of first section 403.

Cover 400 further comprises one or more holes, e.g. 421 and 422, at the bottom wall to provide access to cavity 420 from the outside. Holes 421 and 422 are used to fill compartment 420 with epoxy after cover 400 is snap coupled with housing 300.

FIG. 5A-5D are illustrations of alternate action switch 500. As illustrated, switch 500 comprises push button 502 and terminals 506 and 508 for connecting separate ends of the primary cable. Thus, terminals 506 and 508 are approximately located in the primary cable channel when switch 500 is in the housing 300. In use, the user pushes button 502 to activate or deactivate the switch.

As shown in the illustrations and discussed herein, the switch assembly is compact in size, secure and stable with enhanced sealing to prevent moisture contamination. The switch assembly is also not susceptible to inadvertent activation. A user, e.g. pilot, wearing a thick glove can easily activate the switch by finger or palm. The switch assembly also provides tactile feedback to the user with the clicking action of the push button 502.

While the invention herein disclosed has been described by means of specific embodiments and applications thereof, numerous modifications and variations could be made thereto by those skilled in the art without departing from the scope of the invention set forth in the claims.

What is claimed is:

1. A durable and secured switch apparatus comprising:

an alternate action switch comprising a switch body, a push button on a proximal end of the switch body, and two primary cable terminals on a distal end of the switch body, wherein the two primary cable terminals are configured for in-line coupling of separate ends of a primary cable;

a housing having a lumen configured to securely retain the switch body, wherein said lumen is further configured with a first peripheral spacing between said switch body and a first section of said lumen at the proximal end of said switch body, and a second peripheral spacing between said switch body and a second section of said lumen at the distal end of said switch body, wherein said lumen further includes a stop between said first section and said second section to prevent downward movement of the switch body within said housing and a peripheral notch in said second section, wherein the two primary cable terminals are perpendicular with respect to the peripheral notch and the primary cable channel, wherein said housing further includes a first part of a primary cable channel running across and centered at said distal end of said housing, wherein at least a top surface of the push button is located external to the housing; and a cover configured to snap fit into said peripheral notch to secure said cover to said housing and enclose said primary cable terminals, wherein said cover includes a cavity for said primary cable terminals, wherein said cover further includes a second part of said primary cable channel running from one side of said cover to an opposing side of said cover, wherein said first part and said second together form said primary cable channel configured for electrically in-line coupling of the primary cable terminals with the primary cable.

2. The apparatus of claim 1, wherein said cover further comprises one or more external access holes for injecting a sealing material into said cavity.

3. The apparatus of claim 1, wherein said first peripheral spacing, said second peripheral spacing and said cavity are filled with a sealing material.

4. The apparatus of claim 1, wherein a spacing between an outside wall of said housing and an outside wall of said cover forms a secondary cable channel that is parallel to the primary cable channel.

5. The apparatus of claim 4, wherein said secondary cable channel is configured for mechanically retaining but not electrically coupling a secondary cable to said housing.

6. The apparatus of claim 1, wherein the cover has at least one diameter equal to a diameter of the distal end of the housing.

7. The apparatus of claim 1, wherein the cover has at least one diameter equal to a diameter of the distal end of the housing and the at least one diameter is where the cover snap fits into the housing.

8. The apparatus of claim 1, wherein the cover has more than one section of different diameters.

9. The apparatus of claim 1, wherein the cover has more than one section of different diameters, wherein at least one diameter of the more than one is equal to a diameter of the distal end of the housing and the at least one diameter is where the cover snap fits into the housing.

10. The apparatus of claim 1, wherein the first section of said lumen comprises two sections of different diameters.

11. The apparatus of claim 10, wherein the stop has a smallest diameter of all sections of the lumen.

12. The apparatus of claim 1, wherein the stop has a smallest diameter of all sections of the lumen.

13. A system comprising:

an alternate action switch comprising a switch body, a push button on a proximal end of the switch body, and two primary cable terminals on a distal end of the switch body, wherein the two primary cable terminals are in-line coupled to separate ends of a primary cable;

a housing having a lumen that securely retains the switch body, wherein said lumen has a first peripheral spacing between said switch body and a first section of said lumen at the proximal end of said switch body, and a second peripheral spacing between said switch body and a second section of said lumen at the distal end of said switch body, wherein said lumen further includes a stop between said first section and said second section to prevent downward movement of the switch body within said housing and a peripheral notch in said second section, wherein the two primary cable terminals are perpendicular with respect to the peripheral notch and the primary cable channel, wherein said housing further includes a first part of a primary cable channel running across and centered at said distal end of said housing, wherein at least a top surface of the push button is located external to the housing;

a cover that is snap fit into said peripheral notch that secures said cover to said housing and encloses said primary cable terminals, wherein said cover has a cavity for said primary cable terminals, wherein said cover further includes a second part of said primary cable channel running from one side of said cover to an opposing side of said cover, wherein said first part and said second together form said primary cable channel; and the primary cable is within said primary cable channel.

* * * * *